US005658527A

United States Patent [19]

Nakamura

[11] Patent Number: 5,658,527

[45] Date of Patent: Aug. 19, 1997

[54] METHOD OF DETECTION AND TREATMENT OF FIRES IN SEAL MEANS OF COMPARTED ENTRANCE AND EXIT OF FURNACE FOR CONTINUOUS THERMAL TREATMENT OF METALLIC STRIPS AND THE LIKE

[75] Inventor: Teruhisa Nakamura, Shin Nanyo, Japan

[73] Assignee: Nisshin Steel Co., Ltd., Tokyo, Japan

[21] Appl. No.: 583,057

[22] PCT Filed: May 31, 1995

[86] PCT No.: PCT/JP95/01062

§ 371 Date: Jan. 19, 1996

§ 102(e) Date: Jan. 19, 1996

[87] PCT Pub. No.: WO95/33521

PCT Pub. Date: Dec. 14, 1995

[30] Foreign Application Priority Data

Jun. 3, 1994 [JP] Japan ..... 6-144038
Oct. 19, 1994 [JP] Japan ..... 6-278640

[51] Int. Cl.[6] ..... C21D 11/00

[52] U.S. Cl. ..... 266/44; 266/78; 266/103

[58] Field of Search ..... 432/43, 47, 49, 432/242, 244; 266/78, 44, 102, 103

[56] References Cited

U.S. PATENT DOCUMENTS

| | | | |
|---|---|---|---|
| 2,367,174 | 1/1945 | Renkin | 432/242 |
| 3,291,468 | 12/1966 | Albertsen et al. | 266/103 |
| 3,306,594 | 2/1967 | Bauer | 432/242 |

*Primary Examiner*—Scott Kastler
*Attorney, Agent, or Firm*—Kanesaka & Takeuchi

[57] ABSTRACT

A seal device is provided in each comparted entrance and exit of a furnace for continuous thermal treatment of a metallic strip using a flammable atmospheric gas. The seal device is provided with seal members for sandwiching the metallic strip to seal the flammable atmospheric gas, seal hardwares each being fixed to a furnace body and pressed by the seal member, and seal mechanisms for sealing the flammable atmospheric gas from the seal member at an urgent time. A differential distribution detector having heat-receiving portions formed of a metallic pipe filled with air is placed over the whole width outside the seal member. When a leaked atmospheric gas is ignited outside the seal member, a rapid temperature increase in the heat-receiving portions is detected to give a signal, whereby running of the metallic strip is stopped, and the seal mechanism is operated to shut off the seal device from the inside of the furnace body. Then, a nitrogen gas is fed into the seal device.

6 Claims, 6 Drawing Sheets

METHOD OF DETECTION AND TREATMENT OF FIRES IN SEAL MEANS OF COMPARTED ENTRANCE AND EXIT OF FURNACE FOR CONTINUOUS THERMAL TREATMENT OF METALLIC STRIPS AND THE LIKE

TECHNICAL FIELD

The present invention relates to a method of detection and treatment of fires in a seal means in the comparted entrance and exit of a furnace for continuous thermal treatment of metallic strips and the like, by which in the vicinity of the outside of the seal means provided in each of the comparted entrance and exit using a flammable atmospheric gas having a danger of explosions or fires, such as furnaces for continuous thermal treatment or equipments for continuous painting wherein metallic strips such as stainless steel strips and other alloy steel strips, high alloy strips, copper alloy strips and copper strips are subjected to bright annealing or stress relief annealing without forming an oxide film (such furnaces or equipments being hereinafter referred to as "furnaces for continuous thermal treatment of metallic strips"), the ignition can be quickly detected and treated when the leaked flammable atmospheric gas is ignited by dropping of red hot refractories, spark of static electricity or the like.

BACKGROUND OF THE INVENTION

In furnaces for continuous thermal treatment wherein metallic strips such as stainless steel strips and other alloy steel strips, high alloy strips, copper alloy strips and copper strips are subjected to bright annealing or stress relief annealing without forming an oxide film, when the case of vertical furnaces is concerned and explained, a metallic strip to be thermally treated (such a metallic strip being hereinafter sometimes referred to as "strip") comes into the furnace from a lower portion of the furnace, goes inside the furnace and comes out again from the lower portion of the furnace. For the reason for preventing the oxidation of the strip and other reasons, a flammable gas having a danger of explosions or fires, such as, for example, a hydrogen gas-containing gas, is fed into such a furnace.

Also, in equipments for continuous painting, an organic solvent which generates a flammable gas having a danger of explosions or fires is used in painting compartments of the metallic strip.

In portions of an entrance and an exit through which the strip or the like passes in compartments of such a furnace for continuous thermal treatment and the like, wherein a flammable atmospheric gas having a danger of explosions or fires is used, seal members having various structures and shapes and seal means for shutting off the compartment with flammable atmosphere from outside of the furnace by means of a pad comprising a felt, an elastic rubber or the like in addition to these seal members (such seal means being hereinafter sometimes referred to as "seals") are commonly used in sites held in contact with the strip.

As a representative example of furnaces for continuous thermal treatment and the like, conventionally used general furnaces for bright annealing of stainless steel strips and a seal means provided in the comparted entrance and exit of a furnace body will be hereunder explained.

FIG. 6 is an explanatory drawing of the schematic structure of a conventionally used furnace for bright annealing of stainless steel strips, wherein a strip 1 passes through a seal means 4 provided in the entrance side of a furnace body 2 via a roll 3, comes into the furnace body 2, and passes again through the seal means 4 on the exit side of the furnace body 2 when comes out. The furnace is operated in such a manner that in order to prevent the formation of an oxide film when the passing strip 1 is heated and subjected to annealing, a hydrogen gas-containing reducible flammable atmospheric gas 10, such as a gas comprising 75% of $H_2$ and 25% of $N_2$, is always fed into the furnace body 2, and the furnace pressure is kept at from about 10 to 50 $mmH_2O$ higher than atmospheric pressure outside of the furnace, so that the flammable atmospheric gas 10 fed into the furnace body 2 leaks out gradually into outside air from the seal means 4 provided in the exit side and the entrance side.

The seal means 4 provided in the exit side and the entrance side in the comparted state in such a furnace for bright annealing will be explained in more detail.

FIG. 7 is an enlarged front cross-sectional view to show the main portion of the examplified conventionally used seal means 4 provided in the exit side of a furnace for bright annealing. In this example, the seal means 4 is mainly comprised of a seal member 5 and a seal hardware 8 fixed to the furnace body 2. The seal member 5 is a press body to press the strip 1 and a felt pad 8*a* with elasticity provided on the seal hardware 8 fixed to the furnace body 2. The seal member 5 as a press body has such a structure such that the seal member is comprised of an elastomer roll or metallic roll 5*a* coated with an elastomer (such a roll being hereinafter sometimes simply referred to as "seal roll") and is provided nearest to the exit side of the furnace body 2.

In such a seal means 4, a roll closing/opening device 7 for moving the seal roll 5*a* in the direction of the side of the strip 1 or in the opposite direction is, provided for example, as shown in FIG. 2. FIG. 2 is a front explanatory drawing to show the vicinity of the seal means 4 in the furnace for bright annealing in which the method of the present invention was carried out as described below. Referring to FIG. 2, the roll closing/opening device 7 shown in this drawing has a structure in which a bearing 5*c* supporting a roll axis 5*b* of the seal roll 5*a* is provided in the tip edge portion of a lever 7*b* pivotally mounted on a securing pin 7*c* acting as a center of rotation, and an actuating force of a cylinder 7*a* is applied in the rear edge portion. In the seal means 4 shown in FIG. 2, the state is shown that a metallic roll 5*a* coated with an elastomer is, for example, used as the seal roll 5*a* and that this roll 5*a* is directly pressed and sealed to a bare seal hardware 8 not provided with the felt pad 8*a* as explained with reference to FIG. 7.

Also, as the conventional seal means 4 provided in the exit side of the furnace for bright annealing, another example can be explained with reference to FIG. 3. FIG. 3 is a cross-sectional explanatory drawing to show the main portion of another seal means 4 in the furnace for bright annealing wherein the method of the present invention was carried out as described below. Referring to FIG. 3, the seal roll 5*a* shown in this drawing is constructed so as to have such a structure that it can indirectly press the strip 1 and the seal hardware 8 fixed on the side of the furnace body 2 via a felt strip 5*d* with elasticity to thereby shut off the inside of the furnace body 2 from outside air and seal the flammable atmospheric gas 10.

This felt strip 5*d* is drawn by the friction with the strip 1, the seal roll 5*a* is provided with a detent, and in the case that contaminants or stains are accumulated on the contact surface of the felt strip 5*d*, the detent is removed so that the seal roll 5*a* is rotated. That is, the seal roll 5*a* does not rotate except when a clean portion of the felt strip 5*d* comes into contact with the strip 1. Such a felt strip 5*d* has a wider width than the strip 1, and in the edge portion in the width direction of the strip 1, the formation of a gap corresponding to the thickness of the strip 1 is prevented by the elasticity of the felt strip 5*d* by itself, or even by the elasticity in the case that the surface of the seal roll 5*a* is comprised of an elastomer. However, the furnace is actually operated in such a manner that in the outside of the felt strip 5*d*, the flammable atmospheric gas 10 leaks out in a small amount through the felt strip 5*d* by itself or a small gap.

In any of the conventional seal means 4 as described in detail with reference to FIG. 1 and FIG. 3, a seal mechanism 6 which at the time of fires of the seal portions or the like, shuts off the seal means 4 from the inside of the furnace body 2 to thereby seal the flammable atmospheric gas 10 is provided in the inner portion of the furnace body 2 away from the portions of the seal member 5 and the seal hardware 8 of the seal means 4. This seal mechanism 6 will be explained with reference to FIG. 1 as well as FIG. 4 which is a side explanatory drawing of FIG. 1.

The seal mechanism 6 is constructed in such a manner that gate members 6*a* and 6*a* are provided just over a narrow passage through which the strip 1 can pass, and fixed with a felt or an equivalent thereto in each of the edge portions opposite to each other so as to close the passage. The gate members slide on the base member constructing the above-described narrow passage in the direction perpendicular the strip 1, whereby the strip 1 is sandwiched by the both gate members 6*a* and 6*a*, and axes 6*c* each connecting a cylinder 6*d* to a guide axis 6*b* of the above-described gate member 6*a* arranged in each of the both sides in the width direction of the strip 1 are provided such that their centers of axis move back and forth in parallel to each other and synchronously in the direction perpendicular to the strip 1.

With respect to the gas in the vicinity of the outside of the seal means 4 having such a structure, the used gas is the flammable atmospheric gas 10 and as described above, always leaks out from the vicinity of the seal member 5 and the felt pad 8*a* provided on the seal hardware 8 of the seal means 4. Therefore, taking into consideration of safety, outside region of the furnace of the seal means 4 is usually isolated, and the gas in this circumference is exhausted out by force.

However, since the flammable atmospheric gas 10 is a very dry gas so that its dew point is close to −50° C., the circumference of the seal member 5 and the seal hardware 8 of the seal means 4 is in the state that the static electricity likely generates. Since the circumference is in such a state, in the case that the seal roll 5*a* is an elastomer roll or a metallic roll coated with an elastomer, an electrification phenomenon caused by deformation peeling and the like of the elastomer takes place by the press rotation of the seal roll 5*a* itself. Also, a static electricity is generated on its surface by the friction with the felt pad 8*a* caused by the press rotation as the main reason. As described above, since the furnace is operated in such a manner that the flammable atmospheric gas 10 always leaks out from the furnace body 2, even when the static electricity charged on the seal member 5 slightly generates sparks, the leaked atmospheric gas 11 is ignited. Further, it makes an ignition source when red hot refractories and the like drop from the furnace body 2 and are discharged out from the furnace body 2. When this leaked atmospheric gas 11 is once ignited, since the flammable atmospheric gas 10 always leaks out as the leaked atmospheric gas 11, the burning of the leaked atmospheric gas 11 continues so that the seal means 4 is burned out or melted down to thereby damage the seal function and further result in serious accidents such as explosions. Therefore, some treatments must be given.

As the conventional treatments, the operation was taken in such a way that when a worker discovers the ignition of the leaked atmospheric gas 11, the feeding of the strip 1 is stopped, the seal mechanism 6 is shut off from the inside of the furnace body 2 and the seal means 4, and a nitrogen gas is fed into a space between the seal mechanism 6 and the seal means 4 in each of the comparted entrance and exit to thereby separate the flammable atmospheric gas 10 in the furnace from atmosphere and shut off the leakage of the flammable atmospheric gas 10, whereas a carbon dioxide gas is blown in the vicinity of the outside of the furnace of the seal means 4 to effect the extinction. However, the discovery of the ignition was likely delayed, and the extinction works lacked safety.

In recent years, by means of the factory automation an unattended operation has been promoted so that no workers are arranged in the circumference of the furnace. Thus, a means for quickly and automatically detecting the ignition of the leaked atmospheric gas 11 has been demanded. That is, in the case that the flammable atmospheric gas 10 contains a hydrogen gas, since the ignition usually takes place accompanied with a large explosion sound at the time of the ignition of the leaked atmospheric gas 11, if the workers are present in the vicinity of the furnace, the ignition of the leaked atmospheric gas 11 can be discovered relatively surely and quickly. On the other hand, in the case that the operation is controlled by monitoring from a control room far from the furnace for continuous thermal treatment and the like and that no workers are arranged in the circumference of the furnace, the workers in the control room can not hear the sound of the explosion at the time of the ignition of the leaked atmospheric gas 11. Further, in the case that the major ingredient of the flammable atmospheric gas 10 is hydrogen, since a flame generated by burning of the leaked atmospheric gas 11 is colorless and transparent, the ignition of the leaked atmospheric gas 11 is acknowledged first when the seal member 5 and the like are scorched and damaged to some extent. As a countermeasure against this, a spot type detector was hitherto set up in some cases.

Examples of the spot type detector include those enumerated below.

(1) Constant temperature type: a detector which sounds an alarm when the temperature reaches a certain constant level, while utilizing bimetals or thermal fuses. The detection can be effected only in a portion where the detector is set up.

(2) Differential type: a detector having an air chamber, wherein when the temperature rapidly increases, air in the air chamber is expanded to push up the diaphragm, and the contact point is closed to thereby sound an alarm. When the temperature slowly increases, since the expanded air in the inside leaks off from a previously provided leak-off hole, the pressure in the air chamber does not increase. The detection can be effected only in a portion where the detector is set up.

(3) Flame-sensitive type utilizing infrared rays: a detector which sounds an alarm, while utilizing the resonance radiation of radiated carbon dioxide gas by flickering of infrared rays having a peak at 4.4 μm radiated from carbon dioxide gas at 2 to 15 Hz because in general fires, a large amount of carbon dioxide gas is emitted. However, since even when the hydrogen gas is burned, no carbon dioxide gas is emitted, the detection can not be effected directly. Since the detection can not be effected unless the hydrogen gas is burned to burn the felt and the like and emit the carbon dioxide gas, it is delayed to sound an alarm. Further, since the detection can not be effected when sight is hindered by pipings and structures, and there are formed a lot of dead angles in complicated structures such as in the vicinity of the seal means 4, this type is not practically useful.

(4) Flame-sensitive type utilizing ultraviolet rays: a detector for general fires, while utilizing ultraviolet rays. In general, since in many cases, many fluorescent lamps, mercury vapor lamps, and halogen vapor lamps, or even electrical shock insecticidal lamps, each emitting ultraviolet rays, are provided in the circumference of the furnace, such is inconvenient for the detection. Also, since the detection can not be effected when sight is hindered by pipings and structures as in the flame-sensitive type utilizing infrared rays, there are formed a lot of dead angles in complicated structures such as in the vicinity of the seal means 4 so that this type is not practically useful.

For these reasons, the constant temperature type or differential type was hitherto reluctantly set up in portions where the means was not interrupted, and all of portions where the flammable atmospheric gas 10 leaked out as the leaked atmospheric gas 11 could not be watched.

Specifically, in recent years, in the seal means 4, an elastomer roll or a metallic roll coated with an elastomer is used as the seal roll 5*a*, or the sealing properties of the means using the felt pad 8*a* provided on the seal hardware 8 is improved. Thus, the flammable atmospheric gas 10 does not generally leak out with respect to the width direction of the seal member 5 but leaks out concentratively from portions where wear locally occurs or problems occur. For these reasons, the position wherein the leaked atmospheric gas 11 is ignited is not fixed and hence, it is delayed to discover the ignition, and the damages of the seal member 5 and the like are serious, leading to problems including not only easy occurrence of serious accidents but also danger and unsafety.

That is, the seal roll 5*a* having an elastomer, felt pad 8*a*, and felt strip 5*d* have generally a heat resisting temperature of up to from 100° C. to 200° C. in view of their material qualities and upon exposure to fires, the seal roll is burned out or melted down in a unit of several seconds, leading to an increase of damages. As a result, if the damage of the seal member 5 of the seal means 4 and the like is serious, the sealing properties of the seal member 5 remarkably reduce, and the amount of the flammable atmospheric gas 10 leaked out as the leaked atmospheric gas 11 increases. Thus, the flame of the ignited leaked atmospheric gas 11 becomes big, leading to problems including easy occurrence of serious accidents. Accordingly, in the case of occurrence of fires, the extinction must be effected while the damage therefrom is slight. Further, the inspection of the seal member 5 having been possibly damaged must be effected, and the damaged member must be exchanged. The works of exchanging the elastomer roll or metallic roll coated with an elastomer as the seal roll 5*a* which is the seal member 5 must be carried out after stopping the operation and completely discharging out the flammable atmospheric gas 10 in the furnace body 2. Since it is necessary to stop the operation over a long period of time, extinction that will take time, leading to an increase in damage is quite inefficient and resulted in a remarkable drop in the productivity. Accordingly, it is most important that when the leaked atmospheric gas 11 is ignited, the treatment is given while the damages to the seal member 5 and the like are still slight, not leading to serious accidents. For this purpose, a means for quickly and automatically detecting the ignition of the leaked atmospheric gas 11 without aid of the workers has been demanded.

Also, if it is delayed to detect the ignition of the leaked atmospheric gas 11, the sealing properties reduce, and the outside air comes into the furnace body 2 and ignites the flammable atmospheric gas 10 in the furnace body 2, leading to possible great explosions. Thus, from the points of view of not only the unsafe extinction works but also the safety of the whole of the furnace, quick detection and treatment of the ignition of the leaked atmospheric gas 11 have been demanded.

DISCLOSURE OF THE INVENTION

An object of the present invention is to provide a method of detection and treatment of fires in a seal means in the comparted entrance and exit of a furnace for continuous thermal treatment and the like, by which in the vicinity of the outside of a seal means provided in each of the comparted entrance and exit using a flammable atmospheric gas having a danger of explosions or fires, the ignition can be quickly detected and treated upon ignition of the leaked flammable atmospheric gas occurred when burning hot refractories in the furnace and the like drop and are discharged out from the furnace to become an ignition source, or by sparks of static electricity and the like.

In order to achieve the above-described object, the present inventor made intensive and extensive investigations. As a result, it has been found that for the reasons that portions where a flammable atmospheric gas having a danger of explosions or fires leaks out from a seal means provided in each of the comparted entrance and exit of a furnace for continuous thermal treatment are not constant in the width direction of a seal member and the like, and that in the case that this flammable atmospheric gas contains hydrogen, since the flame generated upon ignition of the leaked atmospheric gas is colorless and transparent not emitting a carbon dioxide gas, it is not desired to use an infrared spot type fire detector which is a usual approved article of the Fire Defence Agency of Japan stipulated in the Japanese Fire Services Act. Thus heat-receiving portions of a differential distribution type detector which is also an approved article of the Fire Defence Agency of Japan and is comprised of metallic pipes filled with air, are set up over the whole width of a small space in the vicinity of the outside of seal members in seal means of the comparted entrance and exit of a furnace for continuous thermal treatment and the like and when the flammable atmospheric gas leaked in the vicinity of the outside of the seal members of the above-described seal means is ignited, a rapid increase of the temperature in the heat-receiving portions is detected by the above-described differential distribution type detector; and after running of a metallic strip is stopped by its signal and the seal means are actuated to shut off from the inside of the furnace body, a nitrogen gas is fed into the seal means, then not only the ignition of the leaked atmospheric gas can be quickly detected, but also treatments against the ignition can be quickly taken, the damage of the seal members can be minimized, and the operation superior in the safety for workers and the whole of the furnace can be effected, leading to the accomplishment of the present invention.

BEST MODE FOR PRACTICING

Figure 5:
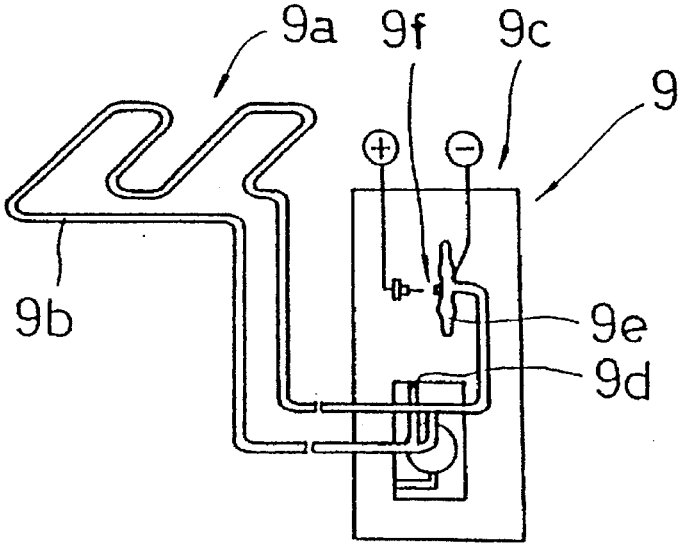
FIG. 5 is a schematic explanatory view to show the structure of a differential distribution type detector used in the method of the present invention.
Figure 6:
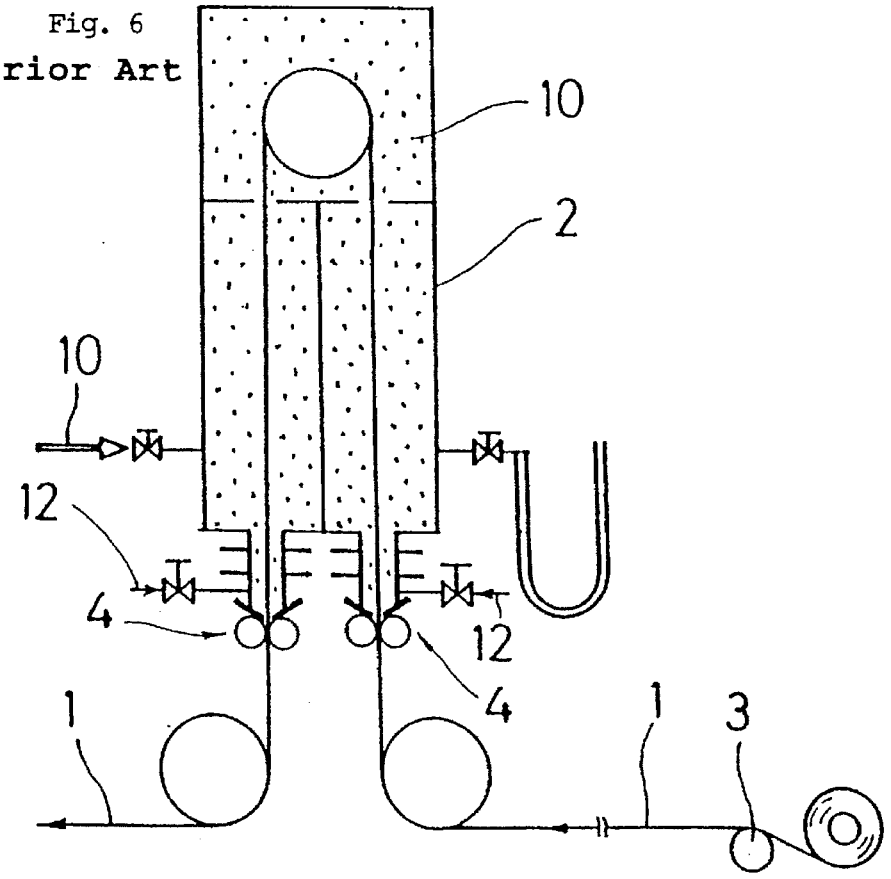
Fig. 6 Prior Art
FIG. 6 is an explanatory drawing of a conventional furnace.
Figure 7:
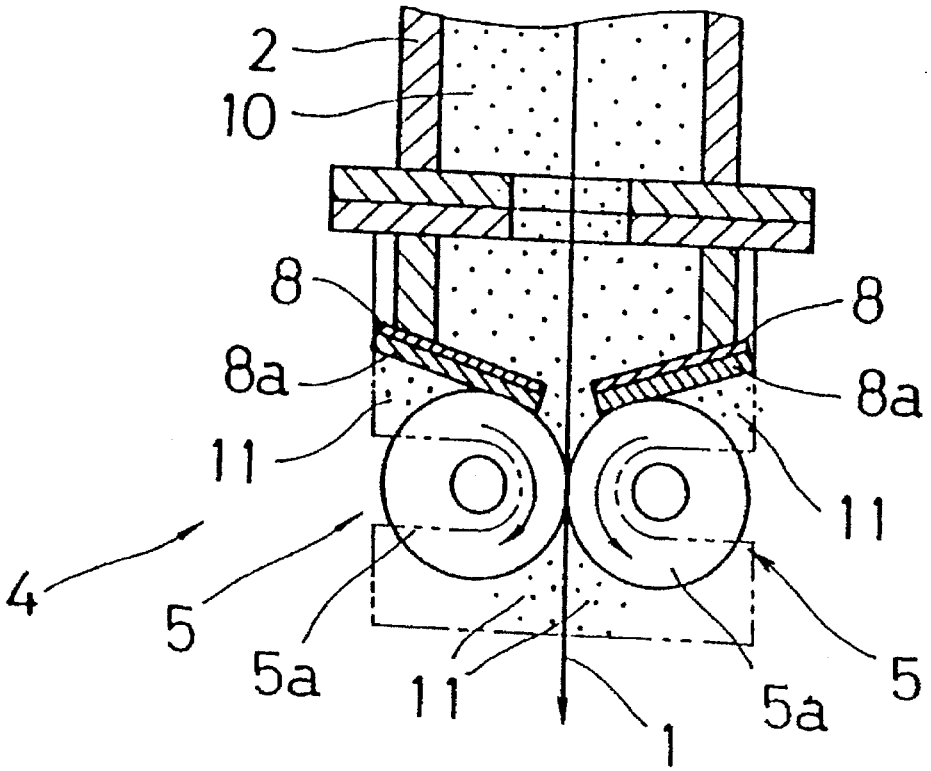
Fig. 7 Prior Art
FIG. 7 is an enlarged front cross-sectional view of a main portion of seal means.

In order to carry out the method of the present invention, a differential distribution type detector 9 is first prepared. This differential distribution type detector 9 comprises a heat-receiving portion 9*a* constructed of a metallic pipe 9*b* containing copper as a major ingredient, which has an inner diameter of 1.4 mm and is filled with air as shown by FIG. 5; and a detection portion 9*c* further having a contact point 9*f* which is controlled either in the closed state or in the open state by the displacement of a diaphragm 9*e* provided in the terminal portion of the heat-receiving portion 9*a* and a leak-off hole 9*d* provided on the metallic pipe 9*b* extending from the heat-receiving portion 9*a*. In the heat-receiving portion 9*a*, when the temperature increases at a prescribed rate or more, air filled in the metallic pipe 9*b* expands and displaces the diaphragm 9*e*, and the contact point 9*f* is made in the closed state, whereby a signal is given. Further, the heat-receiving portion 9*a* is compensated in such a manner that it does not work by a slow temperature change at ordinary times because even when temperature increases slowly by changes in the outside air temperature and the like, air corresponding to the expansion in the metallic pipe 9*b* leaks out from the metallic pipe 9*b* through the leak-off hole 9*d*.

Figure 4:
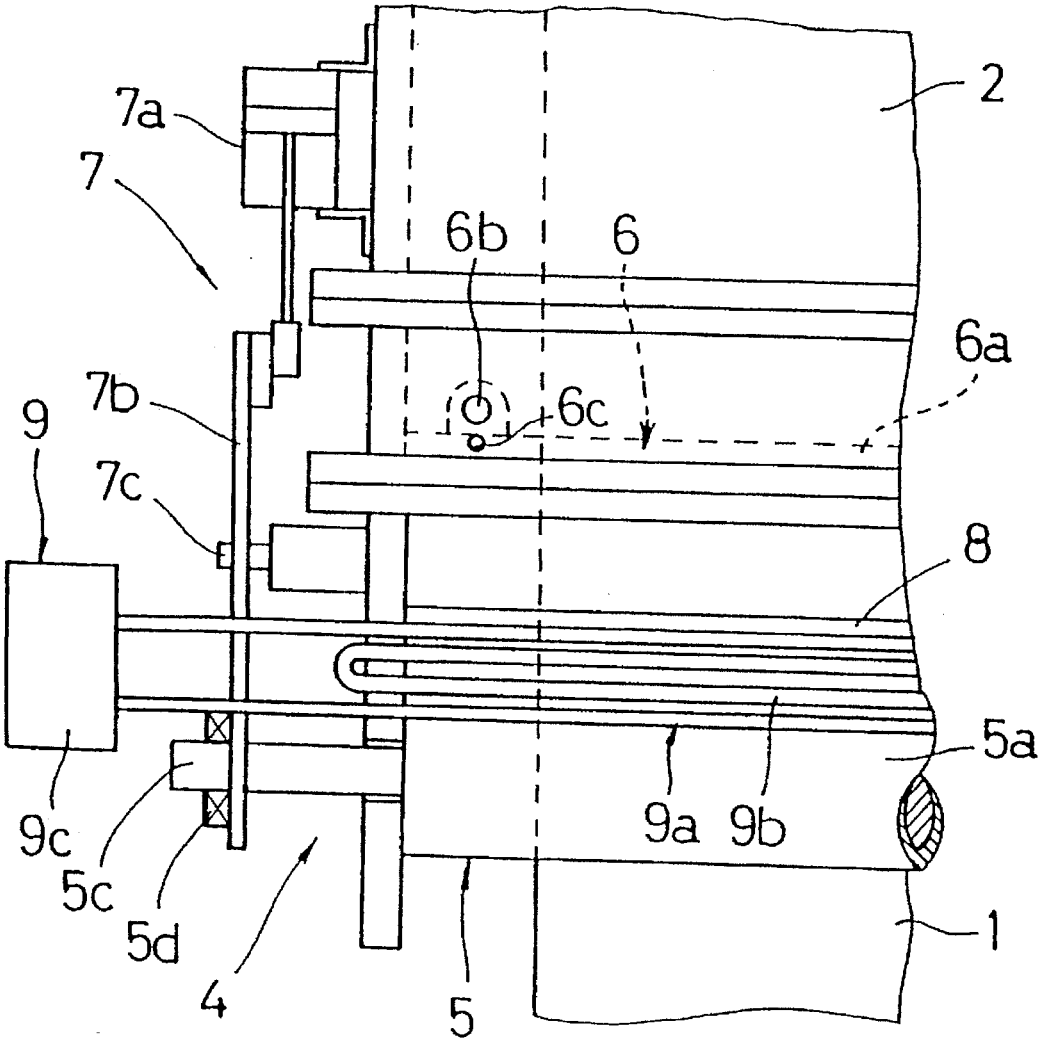
FIG. 4 is a side explanatory view of FIG. 1.

The seal means 4 provided in the entrance side and exit side of the furnace for continuous thermal treatment and the like in which the method of the present invention is preferably carried out may have the same structure as in the conventional ones provided with the seal member 5 and seal hardware 8, seal mechanism 6 and roll closing/opening device 7 can be used. The seal mechanism 6 as described above with reference to FIG. 1 and FIG. 4 can instantly work by an air cylinder such that it works within a short period of time and shuts off the seal means 4 from the inside of the furnace body 2 in the method of the present invention. A rotary door type also can be used in addition to the sliding type as in the example of the present invention. Also, as the furnace for continuous thermal treatment and the like, any of the vertical type and horizontal type can be used.

In the seal means 4, portions where the flammable atmospheric gas 10 possibly leaks out include a portion where the strip 1 is sandwiched by the seal members 5 and a portion where the seal member 5 comes into contact with the seal hardware 8. In the case that the furnace for continuous thermal treatment and the like is a vertical furnace, the circumference of the seal means 4 including these portions which may possibly leak out is shut off, and the gas in this circumference is exhausted out into a safe place such as outdoors by force. In this case, since the leaked atmospheric gas 11 has a specific gravity smaller than that of outside air and hence, flows upwardly, when the leaked atmospheric gas 11 is ignited, the flame extends upwardly.

Figure 1:
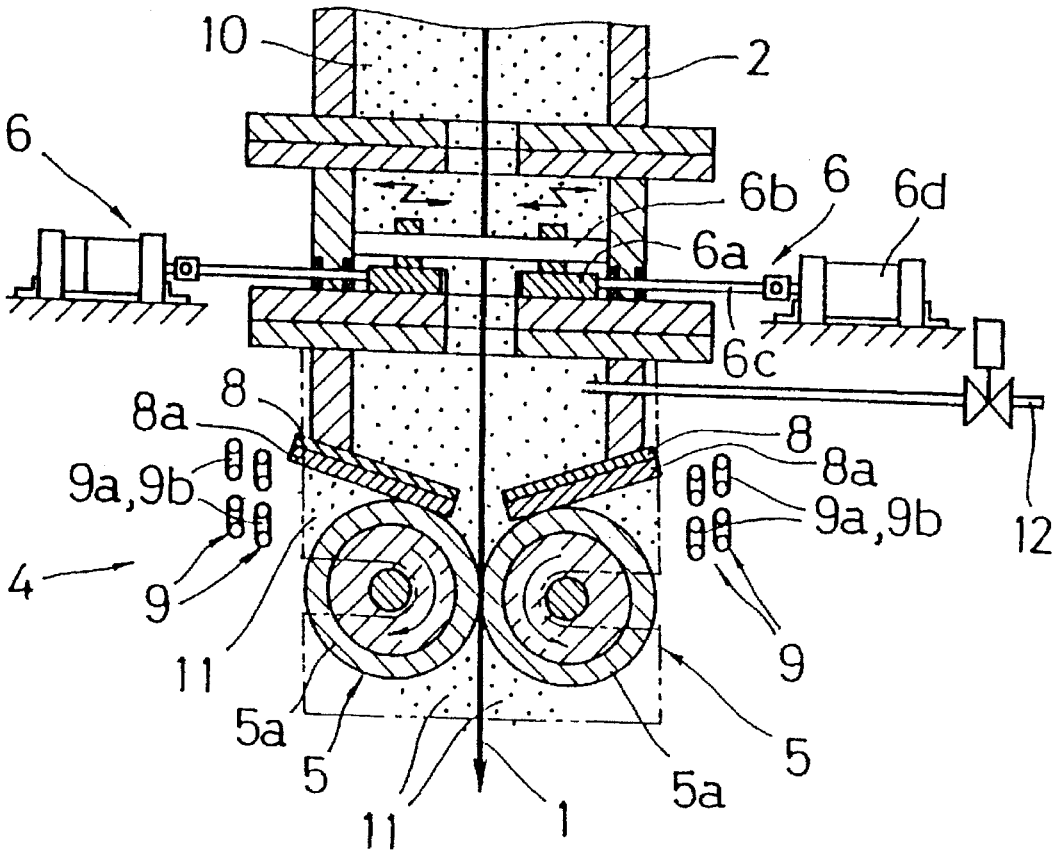
FIG. 1 is a cross-sectional explanatory view of the main portion of a seal means in a furnace for bright annealing in which the method of the present invention is carried out.
Figure 2:
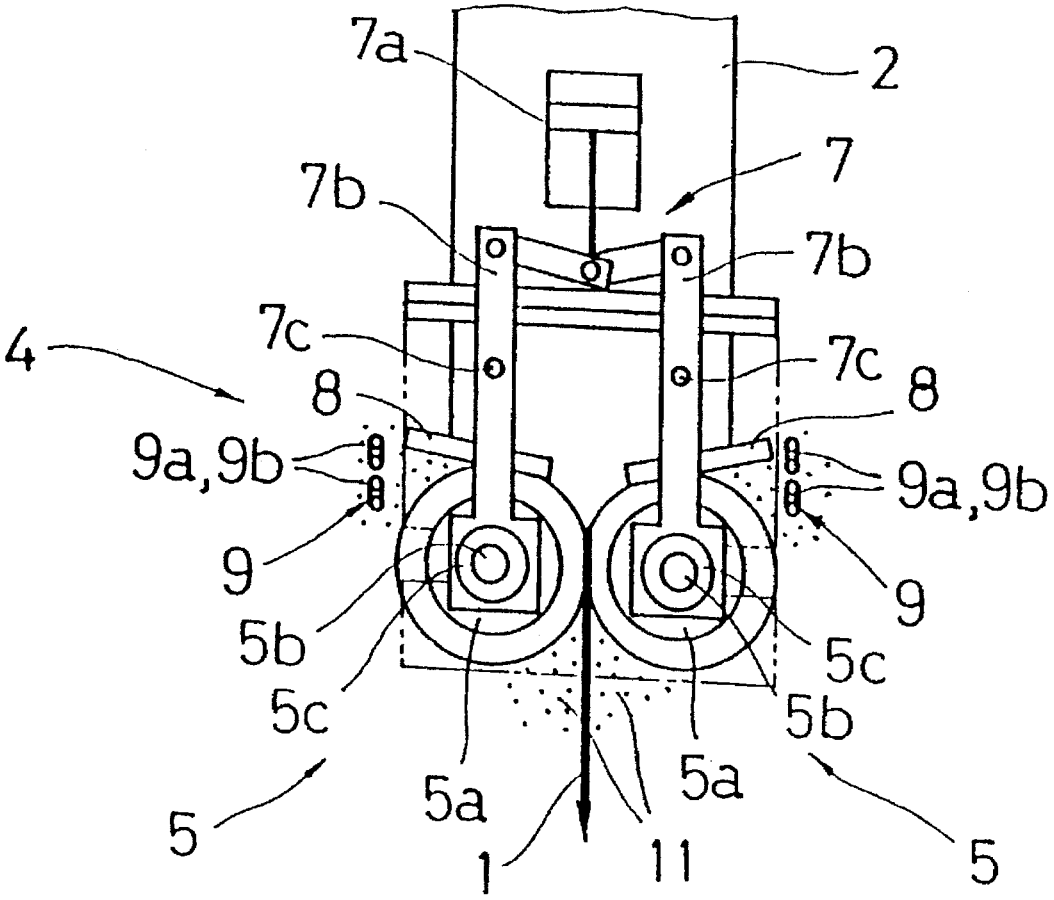
FIG. 2 is a front explanatory view to show the vicinity of a seal means in a furnace for bright annealing in which the method of the present invention is carried out.
Figure 3:
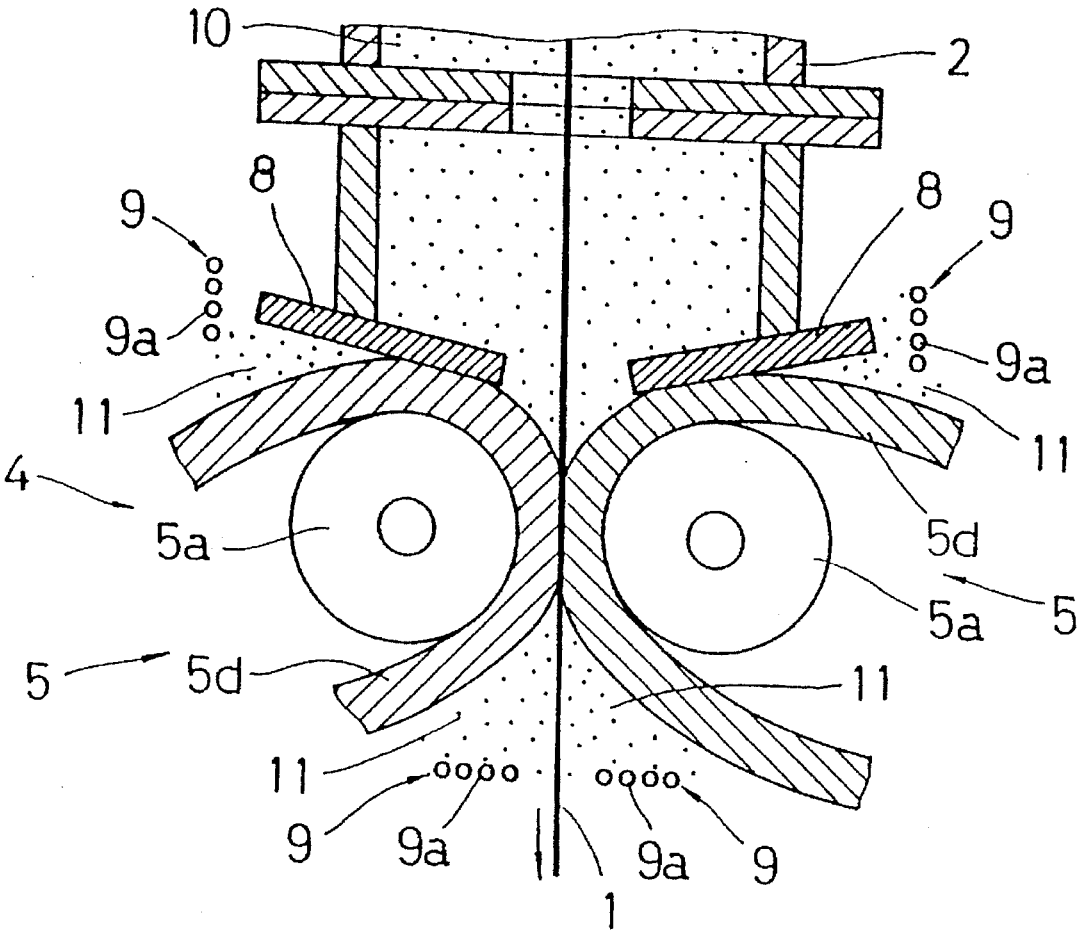
FIG. 3 is a cross-sectional explanatory view of the main portion of another seal means in a furnace for bright annealing in which the method of the present invention is carried out.

Accordingly, the heat-receiving portions 9*a* of the above-described differential distribution type detector 9 are placed over the whole width in the vicinity of the outside of the seal member 5 of the seal means 4, i.e., they are placed and arranged over the whole width of the seal member 5 in the vicinity of the entire portions where the flammable atmospheric gas 10 may leak out as the leaked atmospheric gas 11. In the case that the seal member 5 has the strip 1 sandwiched by the felt strips 5*d* as shown in FIG. 3, since the flammable atmospheric gas 10 passes through fibers of the felt and leaks out and hence, is readily diffusible, the heat-receiving portions 9*a* of the differential distribution type detector 9 can be arranged in the entire portions where the flammable atmospheric gas 10 may leak out. Also, in the case that the seal member 5 has the seal roll 5*a* as shown in FIG. 1 and FIG. 2, in which when the leaked atmospheric gas 11 is ignited, the flame extends upwardly, the heat-receiving portions 9*a* of the differential distribution type detector 9 can be arranged in the vicinity of the portions where the seal roll 5*a* is pressed against the seal hardware 8 or felt pad 8*a* as shown in FIG. 1 and FIG. 2.

It is preferred to arrange two or more systems of the differential distribution type detector 9 in place. This is because when one of the differential distribution type detectors 9 does not work by a fault or the like, the ignition of the leaked atmospheric gas 11 can be surely detected. In this case, needless to say, the operation is controlled in such a way that when the signal sent fastest upon detection of the ignition of the leaked atmospheric gas 11 is received, the passing strip 1 stops, the seal mechanism 6 operates, and a nitrogen gas 12 is fed.

When the leaked atmospheric gas 11 is ignited to rapidly increase the temperature in the outside region of the furnace of the seal member 5, the diaphragm 9*e* in the detection portion 9*c* is subjected to displacement by the thermal expansion of air in the heat-receiving portion 9*a* of the differential distribution type detector 9, the contact point 9*f* is closed to give a signal, the running of the passing strip 1 immediately stops, and the seal mechanism 6 of the seal means 4 is put in operation to shut off the seal means 4 from the inside of the furnace body 2. Since, as the seal mechanism 6, the above-described device can be used as it stands, the explanation is omitted.

Thereafter, the nitrogen gas 12 is urgently fed into the seal means 4 i.e., in the near side of the seal member 5 against the seal mechanism 6 so that the pressure therein is higher than the furnace pressure.

A series of operations in which upon receiving the signal from the differential distribution type detector 9, the running of the passing strip 1 stops, the seal mechanism 6 operates, and the nitrogen gas 12 is then fed are usually controlled in sequence automatically so that the treatment can be quickly taken against the ignition of the leaked atmospheric gas 11.

POSSIBILITY IN INDUSTRY

If the method of the present invention is carried out as described above in detail, when the leaked atmospheric gas 11 passed through the seal member 5 of the seal means 4, the strip 1, and the seal hardware 8 or felt pad 8*a* itself, or the gaps formed therebetween is ignited at the time when the burning hot refractories in the furnace and the like drop and are discharged out from the furnace to become an ignition source, or by sparks of the static electricity charged on the seal member 5 and the like, the temperature in the vicinity of the portion where the leaked atmospheric gas 11 is ignited rapidly increases, and the ignition of the leaked atmospheric gas 11 is quickly detected by the heat-receiving portion 9*a* of the differential distribution type detector 9.

At this time, since the heat-receiving portions 9*a* of the differential distribution type detector 9 are arranged over the whole width of the seal member 5 of the seal means 4 and the like, or arranged over the small gaps formed therebetween, even when the leaked atmospheric gas 11 which has partly leaked out owing to an improvement of the sealing properties in the improved seal means 4, the occurrence of the ignition can be surely and quickly detected. Also, as described above, the detection of the leaked atmospheric gas 11 is made by the temperature increase in the portion where the ignition occurs. Thus, even when the flame generated by the burning of the leaked atmospheric gas 11 is colorless and transparent and can be hardly visible, or even when workers do not hear the sound at the time of the ignition, its generation can be surely detected with a high precision.

In addition, if two or more systems of the differential distribution type detector 9 are arranged in place, even when one of the differential distribution type detectors 9 fails to work by a fault or the like, the ignition of the leaked atmospheric gas 11 can be surely detected.

Thus, when the ignition of the leaked atmospheric gas 11 is quickly and surely detected, the running of the passing strip 1 stops, and the seal mechanism 6 operates by means of the signal of the differential distribution type detector 9. That is, after the running of the passing strip 1 instantly stops upon receiving the signal from the differential distribution type detector 9, the seal mechanisms 6 arranged in the both sides of the width direction of the strip 1 operate, whereby the gate members 6a having a width wider than that of the strip 1 sandwich the strip 1 so as to close the passage of the strip 1, and the flammable atmospheric gas 10 in the furnace body 2 is instantly shut off from the inside of the seal means 4 in the near side of the seal member 5 against the seal mechanism 6 so that it is no more fed.

When the nitrogen gas 12 is urgently fed in the pressure higher than the furnace pressure into the seal means 4 in the near side of the seal member 5 against the seal mechanism 6 of the seal means 4, the flammable atmospheric gas 10 is completely prevented from leaking out from the seal mechanism 6 into the seal means 4 in the near side of the seal member 5. Thus the nitrogen gas 12 leaks out into the circumference of the outside of the seal member 5 to thereby extinguish the flame.

When it is controlled in sequence to automatically perform a series of operations to stop the running of the strip, to operate the seal mechanism 6, and to feed the nitrogen gas 12 by the signal of the differential distribution type detector 9 in this way, the operation from the detection of the ignition of the leaked atmospheric gas 11 to the treatment against it can be surely and quickly effected without aid of workers. Further, not only the ignition of the leaked atmospheric gas 11 can be detected without needs of watching images on infrared tracking cameras or ordinary TV cameras and the like by workers in the vicinity of the seal means 4 or a place far from it such as in a control room, but also the flame of the leaked atmospheric gas 11 can be extinguished. Further, since it is not necessary to perform the watching, the mental or physical burden of the workers can be extremely lightened. Thus, not only the unsafe flame extinction by workers following the ignition but also the unsafety of equipments including the furnace body can be solved, and the furnace can be safely operated.

The method of the present invention can be further carried out in any of vertical or horizontal furnaces for continuous thermal treatment and the like. In particular, in the case that the seal member 5 of the seal means 4 is comprised of an elastomer roll or a metallic roll coated with an elastomer, i.e., a roll rotating together with the passing strip 1, since the damage of the seal member 5 can be minimized, and the seal member 5 can be used over a long period of time, not only the operation is very economical, but also the frequency to carry out the exchange work of the seal member 5 which requires a lot of time and labor in addition to the discharge of all of the atmospheric gas in the furnace can be minimized. Thus, the operation can be efficiently carried out with high productivity.

In the light of the above, the method of detection and treatment of fires in the seal means in the comparted entrance and exit of a furnace for continuous thermal treatment of metallic strip and the like according to the present invention, which can bring various functions and effects, is very valuable from the industrial standpoint.

I claim:

1. A method of detection and treatment of fires in seal means in comparted entrance and exit of a furnace for continuous thermal treatment of a metallic strip, wherein:

the seal means provided in each of the comparted entrance and exit of the furnace for continuous thermal treatment of the metallic strip using a flammable atmospheric gas having a danger of explosions or fires is provided with seal members for sandwiching the metallic strip to seal the flammable atmospheric gas, seal hardwares each being fixed to a furnace body and pressed by the seal member, and seal mechanisms for sealing the flammable atmospheric gas, at an urgent time, of an inside of the furnace body from the seal member, a differential distribution detector having heat-receiving portions comprising a metallic pipe filled with air placed over the whole width in a vicinity of an outside of the seal member is arranged, when a leaked atmospheric gas is ignited in the vicinity of the outside of the seal member of the seal means, a rapid temperature increase in the heat-receiving portions is detected to give a signal, whereby running of the metallic strip is stopped, and the seal mechanism is worked to shut off the seal means from the inside of the furnace body, and a nitrogen gas is then fed into the seal means.

2. A method of detection and treatment of fires in the seal means in the comparted entrance and exit of a furnace for continuous thermal treatment of metallic strips as claimed in claim 1, wherein the seal member of the seal means is an elastomer roll.

3. A method of detection and treatment of fires in the seal means in the comparted entrance and exit of a furnace for continuous thermal treatment of metallic strips as claimed in claim 1, wherein the seal member of the seal means is a metallic roll coated with an elastomer.

4. A method of detection and treatment of fires in the seal means in the comparted entrance and exit of a furnace for continuous thermal treatment of metallic strips as claimed in claim 1, wherein the seal member of the seal means is an elastic seal member to be pressed by a press body.

5. A method of detection and treatment of fires in the seal means in the comparted entrance and exit of a furnace for continuous thermal treatment of metallic strips as claimed in claim 4, wherein the press body is an elastomer roll, a metallic roll, or a metallic roll coated with an elastomer.

6. A method of detection and treatment of fires in the seal means in the comparted entrance and exit of a furnace for continuous thermal treatment of metallic strips as claimed in claim 1 wherein more than two differential distribution detectors are arranged in place.

* * * * *